US005836410A

United States Patent [19]

Kleine

[11] Patent Number: 5,836,410

[45] Date of Patent: Nov. 17, 1998

[54] PERCUSSIVE BLOW ASSISTED ROTARY DRILL

[75] Inventor: Werner Kleine, Achim, Germany

[73] Assignee: Hilti Aktiengesellschaft, Schaan, Liechtenstein

[21] Appl. No.: 762,173

[22] Filed: Dec. 9, 1996

[30] Foreign Application Priority Data

Dec. 7, 1995 [DE] Germany ..... 195 45 648.3

[51] Int. Cl.[6] ..... C21B 10/36

[52] U.S. Cl. ..... 175/415; 175/420

[58] Field of Search ..... 175/296, 415, 175/417, 419, 420

[56] References Cited

U.S. PATENT DOCUMENTS

| | | | |
|---|---|---|---|
| 2,099,677 | 11/1937 | Cunningham | 175/420 X |
| 2,529,788 | 11/1950 | Signell | 175/420 X |
| 3,960,223 | 6/1976 | Kleine | 175/415 X |
| 4,903,787 | 2/1990 | Moser et al. | 175/420 X |

*Primary Examiner*—William P. Neuder
*Attorney, Agent, or Firm*—Anderson, Kill & Olick, P.C.

[57] ABSTRACT

A percussive blow assisted rotary drill, has an axially extending shank (1) with a leading end face (3) and an axially extending outside surface (2) with helically extending drilled material removal grooves in the outside surface. A hard metal main cutting plate (6) and hard metal auxiliary cutting plates (11) are seated in an axially extending leading end region of the shank and are arranged in an X-shaped pattern. The main cutting plate and auxiliary cutting plates project axially outwardly from the leading end face (3) and radially outwardly from the outside surface (2). The auxiliary cutting plates project axially and/or radially outwardly beyond the main cutting plate and, relative to the rotational direction (R) of the drill, the auxiliary cutting plates and the main cutting plate lagging the auxiliary cutting plates form an acute angle. The main drilled material removal grooves are located upstream, relative to the rotational direction, of the auxiliary cutting plates.

10 Claims, 2 Drawing Sheets

PERCUSSIVE BLOW ASSISTED ROTARY DRILL

BACKGROUND OF THE INVENTION

The present invention is directed to a percussive blow assisted rotary drill having an axially extending shank with a leading end face and an axially extending outside surface with at least one helically extending drilled material removal groove. The shank has an axially extending leading end region with a hard metal cutting plate and additional hard metal cutting plates fixed in it. The additional cutting plates extend axially outwardly from the leading end face and radially outwardly from the outside surface of the shank. The cutting plate and the additional cutting plates are arranged in an X-shaped pattern.

Percussive blow assisted rotary drills are drills used in percussive blow assisted rotary drilling tools. In particular, such drilling tools are used with rock or masonry drills used for percussive blow assisted rotary drilling of boreholes and the like in concrete or masonry. Helical drills for drilling in solid rock are disclosed in DE-C-30 20 284 and comprise a drill shank with two drilled material removal grooves extending in a helical form in the outside surface of the shank. Hard metal cutting edges are provided at the leading end of the shank which cut into a receiving material in a chiseling and abrasive manner for preparing a borehole. The hard metal cutting edges are arranged in a cross-shaped form in the leading end face of the shank and they project axially outwardly from the end face. In particular, the hard metal cutting edges are arranged on a continuous hard metal plate extending across a diameter of the drill shank with additional hard metal elements arranged along a diameter of the shank positioned at an angle of 90° to the hard metal cutting plate. Between the main cutting edges located at the cutting plate and the additional hard metal cutting edges, grooves are provided extending parallel to the axis of the shank for discharging drilled material into the removal grooves in the shank. Such grooves serve for removing the drilled material accumulating during the drilling in the receiving material. The main cutting edge and the additional cutting edges project radially outwardly from the outside surface of the shank to prevent jamming of the drill in the borehole being formed. This known drill affords a low range drilling output with a comparable wear of the hard metal cutting edges.

Another percussive blow assisted rotary drill is disclosed in EP-B 0 452 255 and has a hard metal cutting plate positioned along a diameter of the shank and auxiliary hard metal cutting plates formed by pin-shaped members which extend, respectively, axially and radially beyond the shank. The main hard metal cutting edges of the drill are formed on the cutting plate. The additional or auxiliary cutting edges are set back axially relative to the main cutting edges and primarily form only a guide function for the drill. In this improved percussive blow assisted rotary drill, the main and auxiliary hard metal cutting edges are disposed at angles to one another different from 90°. In particular, the arrangement has been selected so that relative to the rotational direction of the drill, the additional cutting edges leading the cutting plate enclose an angle greater than 90° with the cutting plate, while the auxiliary cutting edge lagging the cutting plate forms an acute angle with the cutting plate. Such an arrangement has the advantage that the region located upstream of the main cutting edge is widened so that the main drilled material removal groove can also be widened. In the narrower region lagging in the rotational direction, a narrow auxiliary removal groove can be provided. In this "x-like" arrangement of the cutting plate and the auxiliary cutting plates, an improved removal of drilled material due to the widened main removal grooves upstream of the cutting plate is assured and an adequate guidance is afforded by the auxiliary cutting plates.

It is still desirable to further improve the drilling output of percussive blow assisted rotary drills. In particular, it is desirable to optimize the specific loading of the hard metal cutting plate and of the auxiliary cutting plates. It must be noted, that the central portion of the main cutting plate is subject to different types of loads due to the axial blows of the percussive blow assisted rotary drill than are experienced in the radially outer regions of the cutting plate or of the auxiliary cutting plates which mainly are exposed to shearing stresses. Especially when a borehole is spot drilled, the entire blow energy of the percussive blow assisted rotary drill must be absorbed by the central region of the main cutting plate.

SUMMARY OF THE INVENTION

Therefore, it is the primary object of the present invention to modify a percussive blow assisted rotary drill to such an extent that the different loads acting on the cutting edges of the cutting plates are taken into account. Accordingly, the output capacity of the drill is to be at least maintained while a very efficient evacuation of the drilled materials is assured.

The objects of the present invention are achieved by a percussive blow assisted rotary drill where auxiliary hard metal cutting plates project axially and/or radially from the outwardly located regions of the main cutting plate. Relative to the rotational direction of the drill, the angle between the auxiliary cutting plates and the trailing parts of the main cutting plate is less than 90°. As a result, a main drilled material removal groove is located upstream in the rotational direction of each auxiliary cutting plate. Since the auxiliary cutting plates project beyond the outwardly located regions of the main cutting plate, either axially or radially or both axially and radially, the auxiliary cutting plates assume the function of the principal cutting plate and are subjected to the highest shearing loads when a borehole is being prepared. Since the drilled material removal occurs at the auxiliary cutting plates, the wide main removal grooves for the drilled materials are located upstream of the auxiliary cutting plates relative to the rotational direction of the drill. As a result, the drilled material is conveyed directly into the main removal grooves. The arrangement of the cutting plate and the auxiliary cutting plates is in the shape of an x, where the auxiliary cutting plates leading relative to the rotational direction of the drill form an acute angle with the trailing hard metal cutting plate affording wider main drilled material removal grooves. Accordingly, an even more improved removal of the drilled materials is assured. The cutting edges of the cutting plate fulfill only guidance functions for the percussive blow assisted rotary drill and can be further optimized with regard to such function.

Since the cutting plate is subjected only to low shearing forces due to its guidance of the drill, the danger of loosening the cutting plate along its long sides is reduced. The auxiliary cutting plates, which effect the main drilled material removal, do not extend across the entire diameter of the shank and are imbedded in the shank for a part of its axial extent. Accordingly, the danger of loosening the auxiliary cutting plates is reduced, in spite of the high shearing forces acting on them.

It is advantageous for a further improvement in the removal of the drilled materials, if additional drilled material removal grooves are located downstream of the auxiliary cutting plates relative to the rotational direction of the drilled material. Such additional removal grooves are located in the narrower region between the leading auxiliary cutting plates and the trailing main cutting plate.

During material removal from the borehole wall by the auxiliary hard metal plates, the leading end of the shank tends to yield laterally. To maintain concentric running of the drill, the radial projection of the ends of the main cutting plate amounts to at least 50° of the radial projection of the auxiliary cutting plates. In this way, the leading end of the shank can yield laterally only to a very limited extent and adequate concentric rotation is assured.

The guidance features of the outer ends of the cutting plate are further improved by shaping the outer end faces extending parallel to the shank axis in a curved manner where such curvature is adapted to the curvature of the outside surface of the drill shank. When the radially outer regions of the cutting plate, projecting beyond the outside surface of the shank, contact the borehole wall, they slide because of their curved shape along the borehole wall and do not cause any abrasive material removal. This feature reduces the friction of the drill in the borehole.

To adequately center the percussive blow assisted rotary drill during spot drilling, and while drilling boreholes, the central region of the cutting plate projects in a preferred manner beyond the outwardly located parts of the cutting plate and of the auxiliary cutting plates. Preferably, the central region of the cutting plate is reinforced axially. Accordingly, allowances are made for the very high shock loading of the central region, especially during spot drilling.

In a preferred embodiment of the invention, the main cutting plate is divided into parts interconnected by thin webs. Rated failure or breakpoints are created in the main cutting plate, which prevent the cutting plate from fracturing in an uncontrolled manner if it is subjected to excessive mechanical stresses. A further advantage is in the ability to reduce the amount of expensive material required, that is, the hard metal used for the cutting plate, by the multi-part arrangement of the cutting plate.

It is advantageous, particularly in percussive blow assisted rotary drills of larger diameter, if the radial spacing of the auxiliary cutting plates from the outwardly projecting central region of the main cutting plate is larger than the length of the material webs. In such a design of the drill, according to the pattern of a breakdown bit, the frictional resistance is reduced during the preparation of a borehole. The ring-shaped regions of the receiving material not exposed to abrasive contact, has a very low stability and is comminuted simply by the leading cutting plate or by the leading end face of the shank.

The main cutting plate is preferably formed of an impact resistant material. With such a material, allowance is made for the particularly high shock loads to which the central region of the cutting plate is exposed by axial blows directed at the drill by the percussive blow assisted rotary drill. The auxiliary cutting plates which provide the main material removal, are formed of a harder material than the main cutting plate. Accordingly, it is possible to optimize the different cutting plates according to the various stresses they experience.

In a preferred embodiment of the invention, for reasons of asymmetrical load distribution, the auxiliary cutting plates are located on a single diameter opposite one another and disposed at the same spacing from the center. To afford improved effectiveness of the auxiliary cutting plates providing the main material removal, they are formed of hard metal with the cutting edges having a peaked roof-like shape.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
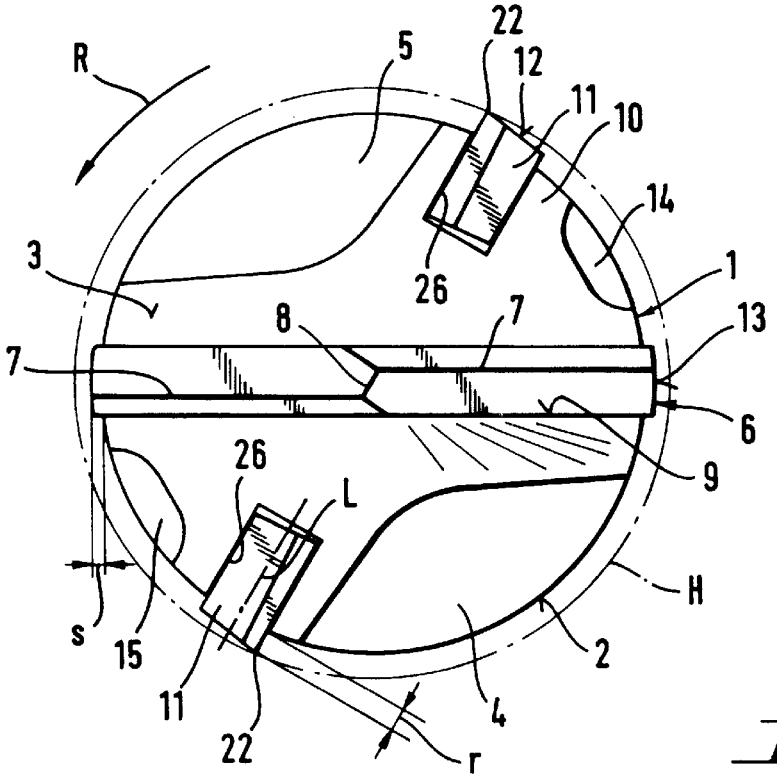
FIG. 1 is a plan view of a first embodiment of a percussive blow assisted rotary drill embodying the present invention.

In FIG. 1 a percussive blow assisted rotary drill is shown having an axially extending shank 1 with two main drilled material removal grooves 4, 5. The shank 1 has a leading end face 3 with a hard metal main cutting plate 6 fitted into the leading end region 10 of the shank and fixed by soldering in a groove 9 extending across a diameter of a shank. The main cutting plate 6 has hard metal cutting edges 7 sloping radially outwardly from a central cutting tip 8 with the cutting tip projecting axially outwardly from the leading end face. The cutting edges 7 slope axially rearwardly from the cutting tip 8 and have a peaked roof-like configuration. In addition, auxiliary cutting plates 11 are secured in the leading end face 3 and extend radially outwardly from an outside surface 2 of the shank 1. The radially extending axis L of the auxiliary cutting plates 11 forms an acute angle with the main cutting plate 6. In the illustrated embodiment, two auxiliary hard metal cutting plates 11 are located diametrically opposite one another with their axis L coinciding with a diameter of the shank 1. As a result, the main cutting plate 6 and the auxiliary cutting plates 11 form an x-shaped pattern. In the embodiment illustrated, the auxiliary cutting plates 11 are spaced at the same distance from the center of the leading end face 3.

The auxiliary cutting plates 11 project radially outwardly by a dimension r greater than the radial outward projection s of the ends of the main cutting plate 6. In this embodiment, the radial projection of the ends of the main cutting plate amounts to at least 50% of the radially outward projection of the auxiliary cutting plates from the outside surface 2 of the shank 1. As a result, the auxiliary cutting plates 11 define an envelope circle H shown in dashed lines in FIG. 1. Relative to the rotational direction R of the percussive blow assisted rotary drill, a main drilled material removal grooves 4, 5 is located upstream from each of the auxiliary cutting plates 11. Auxiliary removal grooves 14, 15 for the drilled material are located between the auxiliary cutting plates 11 and the main cutting plates 6 lagging in the rotational direction R, the auxiliary removal grooves 14, 15 terminate or preferably discharge into the main removal grooves 4, 5 along its shank.

As indicated in FIG. 1, the end faces 13 of the main cutting plate 6 extending parallel to the axis of the shank have a curved configuration. The curvature of the end faces 13 is matched to the curvature of the outside surface 2 of the shank and, preferably, form a portion of a cylindrical surface. The axially extending end faces 12 of the auxiliary cutting plates 11 define the envelope circle H and preferably are shaped as cutting edges 22 to increase the abrasive effect of the auxiliary cutting plates.

Figure 2:
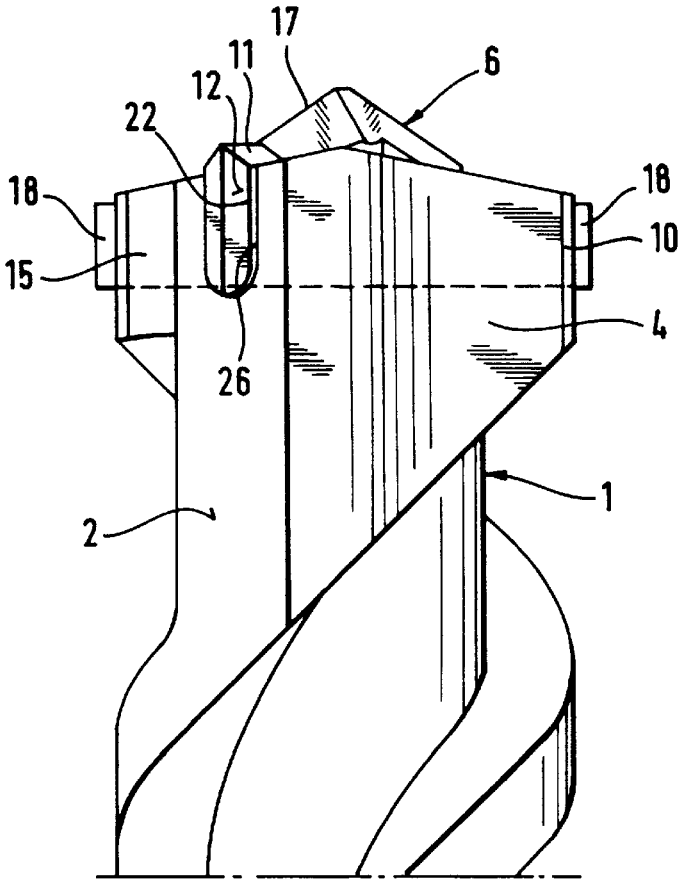
FIG. 2 is a side view of another embodiment of a percussive blow assisted rotary drill embodying the present invention showing only the leading end region of the drill.
Figure 3:
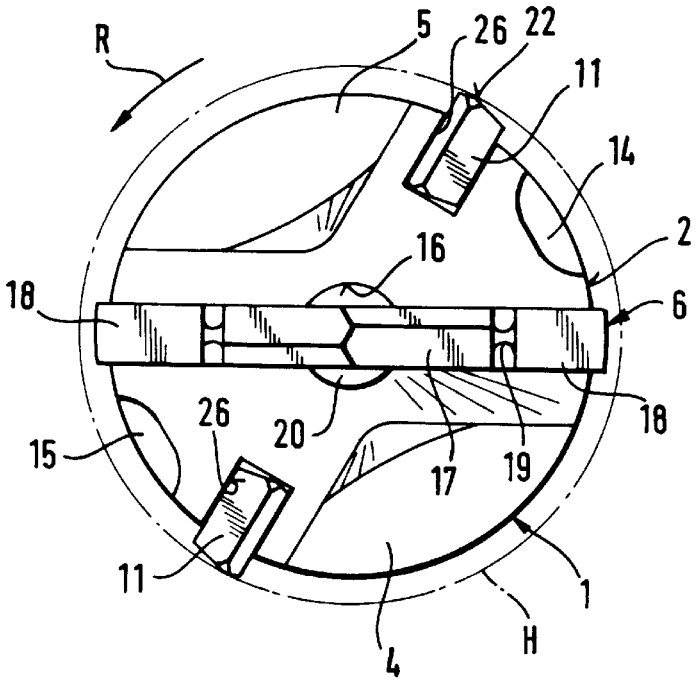
FIG. 3 is a plan view of the embodiment displayed in FIG. 2.
Figure 4:
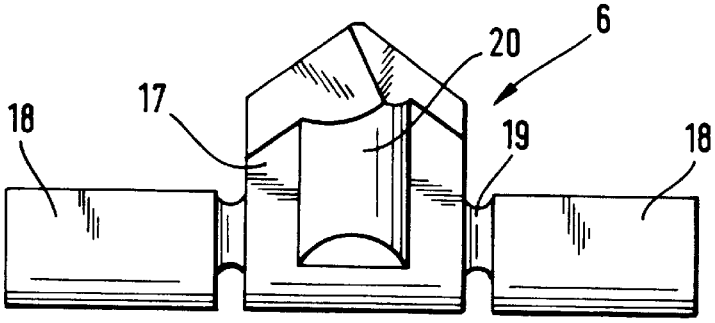
FIG. 4 is a side view of a multi-part unitary cutting plate in accordance with the present invention.
Figure 5:
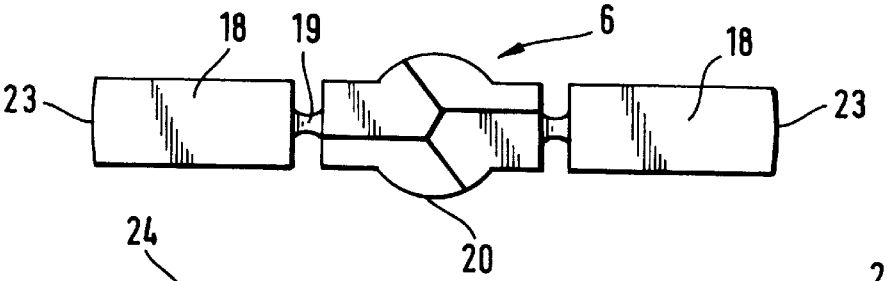
FIG. 5 is a plan view of the cutting plate shown in FIG. 4.

In FIGS. 2 and 3, another embodiment of the percussive blow assisted rotary drill is shown. The drill has an axially extending shank 1 with two main drilled material removal grooves 4, 5 extending from the leading end of the shank, though the full shank is not illustrated. A hard metal main cutting plate is seated in the leading end region 10 of the shank and the cutting plate is divided into connected parts. The main cutting plate is subdivided into a central cutting part 17 and two outwardly located cutting parts 18 connected to the central part by narrow material webs 19 as illustrated in FIGS. 4 and 5. The central cutting part 17 projects axially outwardly from the outwardly located parts 18 and has a reinforcing section 20 in its central region. Groove 9 extends across a diameter of the shank 1 and has a recess 16 in its central region in the leading end face 3 of the shank shaped to receive the reinforced central region of the main cutting plate 6. As a result, the main cutting plate is fixed in a positive manner in the groove 9.

Auxiliary cutting plates 11 extend axially from the shank as well as radially beyond the outwardly located parts 18 of the main cutting plate 6. The spacing of the auxiliary cutting plates 11 from the outwardly projecting tip of the central cutting part 17 is greater than the length of the thin material web 19. Accordingly, the outwardly located parts 18 provide only a guidance function for the percussive blow assisted rotary drill. The material removal function is provided by the auxiliary cutting plates 11 and, to its full extent, by the cutting edge of the central cutting part 17. Since the hard metal cutting plate 6 and especially its central cutting part 17 are initially exposed to axial loads by axial blows directed against the drill in the multi-part main cutting plate, it is advantageous to manufacture the main cutting plate 6 from an impact resistant material. The auxiliary cutting plates 11 which carry out the material removal, and are thus subjected to high abrasive forces, are formed of a harder material than the main cutting plate 6. In both instances, the main and auxiliary cutting plates are formed of a hard metal, known in the state of the art.

As is evident from FIG. 5, the end faces of the main cutting plate 6, that is, the end faces of the outwardly located cutting parts are curved. The end faces 23 form a portion of a cylindrical surface having a curvature matched mainly to the curvature of the outside surface 2 of the shank 1.

Figure 6:
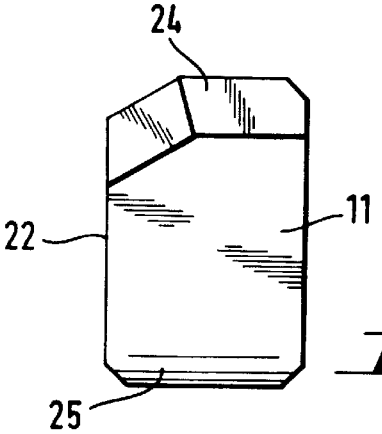
FIGS. 6 and 7 are side views of an auxiliary cutting plate in accordance with the present invention.
Figure 7:
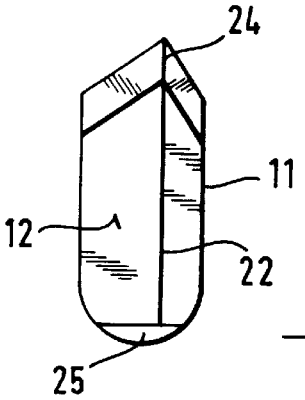

FIGS. 6 and 7 show an embodiment of the auxiliary cutting parts 11 in two side views. FIG. 7 is a top view of the outwardly directed face 12 of the auxiliary cutting plate 11 which in drilling operation is in engagement with a transverse face of the receiving material in which the borehole is being formed. The auxiliary cutting plate has a radially outer cutting edge 24 having an approximately peaked-roof like shape. The outwardly directed end face 12 also has a cutting edge 22 for increasing its effectiveness in actual drilling operations. A base portion 25 of the auxiliary cutting edge 11 is provided with a rounded shape so that it is better adapted to the shape of a bottom of the receiving groove 26 in the shank 1. The receiving grooves 26 for the auxiliary cutting plates 11 are formed as separate grooves as indicated in the embodiments in FIGS. 1 and 3. It is possible, however, to arrange the auxiliary cutting plates in a single receiving groove 26 extending across a diameter of the shank 1 and to fix them in the groove by soldering.

In the percussive blow assisted rotary drill of the invention, the auxiliary cutting plates project beyond the radially outer ends of the main cutting plate axially or radially or both axially and radially. In such an arrangement, the auxiliary cutting plates assume the cutting function and are subjected to the highest shearing loads while a borehole is being drilled. Since the main material removal takes place at the auxiliary cutting plates, the main removal grooves for the drilling material are located upstream of the auxiliary cutting plates relative to the rotational direction of the drill. As a result, the drilled material is conveyed directly into the main removal grooves. The arrangement of the main cutting plate and the auxiliary cutting plates is in the form of an x, where the auxiliary cutting plates leading relative to the rotational direction of the drill form an angle less than 90° with the lagging main cutting plate and thus allow the main removal grooves to be widened. This arrangement affords an even better removal of the drilled material. The hard metal cutting edges of the main cutting plate afford only a guidance function for the percussive blow assisted rotary drill and can be further optimized in view of this task.

While specific embodiments of the invention have been shown and described in detail to illustrate the inventive principles, it will be understood that the invention may be embodied otherwise without departing from such principles.

What is claimed is:

1. A percussive blow assisted rotary drill comprising an axially-extending shank (1) having a leading end face (3) and an axially extending outside surface with at least one helically extending drilled material removal groove (4, 5), said shank having a rotational direction (R) about the axis thereof and an axially extending leading end region (10) with a main hard metal cutting plate (6) and a pair of auxiliary hard metal cutting plates (11) fixed therein and said main cutting plates and auxiliary cutting plates extending axially outwardly from said leading end face and radially outwardly from said outside surface, each of said auxiliary cutting plates located on an opposite side of said main cutting plate from the other said auxiliary cutting plate, said main cutting plate (6) disposed relative to said auxiliary cutting plates in an X-shaped pattern, said auxiliary cutting plate extending at least one of axially outwardly from and radially outwardly from said main cutting plate, in the X-shaped pattern each said auxiliary cutting plate (11) forming an acute angle with said main cutting plate lagging the auxiliary cutting plate in the rotational direction (R) and forming an obtuse angle with said main cutting plate leading the auxiliary cutting plate in the rotational direction, and said at least one main removal groove (4, 5) being located ahead in the rotational direction of at least one of said auxiliary cutting plates in the region of one of the obtuse angles between one of said auxiliary cutting plates and said main cutting plate.

2. A percussive blow assisted rotary drill, as set forth in claim 1, wherein auxiliary drilled material removal grooves (14, 15) are arranged relative to the rotational direction (R) in the regions of the acute angles between said auxiliary cutting plates (11) and said main cutting plate.

3. A percussive blow assisted rotary drill, as set forth in claim 1 or 2, wherein the radially outward extension of said main cutting plate (6) amounts to at least 50% of the radially outward extension of said auxiliary cutting plates (11).

4. A percussive blow assisted rotary drill, as set forth in claim 3, wherein said main cutting plate (6) having opposite end faces extending parallel to the shank axis and being curved relative to the shank axis with the curvature thereof adapted to the curvature of the outside surface (2) of said shank (1).

5. A percussive blow assisted rotary drill, as set forth in claims 1 or 2, wherein said main cutting plate (6) has a central part relative to the axis of said shank (1) projecting axially outwardly and additional parts located radially outwardly from said central part and said main cutting plate having an axially extending and radially outwardly extending reinforcing projection (20) on opposite sides of said central region.

6. A percussive blow assisted rotary drill, as set forth in claims 1 or 2, wherein said main cutting plate (6) is a unitary member divided into a central part (17) and outwardly located parts (18) on opposite ends of said central part with said central part connected to said outwardly located parts by thin webs (19).

7. A percussive blow assisted rotary drill, as set forth in claim 6, wherein said main cutting plate (6) has said central part (17) aligned with the axis of said shank (1) and said auxiliary cutting plates (11) extend transversely of and are spaced outwardly from the central part (17) and said spacing being greater than the length of said material webs (19).

8. A percussive blow assisted rotary drill, as set forth in claim 1 or 2, wherein said main cutting plate (6) is formed of an impact resistant material and said auxiliary cutting plates (11) are formed of a harder material than said main cutting plate (6).

9. A percussive blow assisted rotary drill, as set forth in claim 1 or 2, wherein said auxiliary cutting plates (11) are located diametrically opposite one another relative to the axis of said shank (1) and are spaced equidistantly from the axis of said shank.

10. A percussive blow assisted rotary drill, as set forth in claims 1 or 2, wherein said auxiliary cutting plates (11) have hard metal cutting edges (22, 24) with surfaces thereof sloping axially rearwardly from said cutting edges and having a peaked roof-like configuration.

* * * * *